US005284201A

United States Patent [19]

Hegel et al.

[11] Patent Number: 5,284,201

[45] Date of Patent: Feb. 8, 1994

[54] VERTICAL SHOT MECHANISM FOR DIE CASTING MACHINE

[75] Inventors: Robert Hegel, Holland; Jon R. Mullen, West Olive, both of Mich.

[73] Assignee: Prince Machine Corporation, Holland, Mich.

[21] Appl. No.: 976,266

[22] Filed: Nov. 13, 1992

[51] Int. Cl.[5] ..... B22D 17/12; B22D 17/30

[52] U.S. Cl. ..... 164/312; 164/342

[58] Field of Search ..... 164/312, 314, 342, 343

[56] References Cited

U.S. PATENT DOCUMENTS

| | | | |
|---|---|---|---|
| 4,088,178 | 5/1978 | Ueno et al. . | |
| 4,286,648 | 9/1981 | Takeshima et al. . | |
| 4,287,935 | 9/1981 | Ueno et al. . | |
| 4,655,274 | 4/1987 | Dannoura . | |
| 4,741,379 | 5/1988 | Dannoura . | |
| 4,760,874 | 8/1988 | Mihara . | |
| 4,836,267 | 6/1989 | Ueno et al. . | |
| 4,993,474 | 2/1991 | Uchida | 164/342 X |

FOREIGN PATENT DOCUMENTS

| | | | |
|---|---|---|---|
| 58-103949 | 6/1983 | Japan | 164/312 |
| 62-34655 | 2/1987 | Japan | 164/342 |
| 63-273559 | 11/1988 | Japan | 164/312 |
| 1-178359 | 7/1989 | Japan | 164/312 |
| 2-295661 | 12/1990 | Japan | 164/312 |
| 480159 | 2/1938 | United Kingdom . | |

*Primary Examiner*—J. Reed Batten, Jr.

*Attorney, Agent, or Firm*—Price, Heneveld, Cooper, DeWitt & Litton

[57] ABSTRACT

The shot cylinder mechanism is moved from a position for receiving molten metal to an injection position wherein the molten metal is injected into the die cavity of the die casting machine, and vice versa. The shot cylinder mechanism is swung in open space from one position to the other as it is guided by a linkage system having a geometry that takes advantage of the constant speed of the cylinder to give faster, non-linear motion in moving from one position to the next and then at the end of the injection position, the proper force is exerted on the shot cylinder mechanism to provide a seal between the shot sleeve and the opening leading to the die cavity.

22 Claims, 5 Drawing Sheets

VERTICAL SHOT MECHANISM FOR DIE CASTING MACHINE

BACKGROUND OF THE INVENTION

The present invention relates to an improved vertical shot mechanism or a die casting machine and more particularly to the mechanism for moving the shot cylinder from a position where the molten metal is introduced into the shot chamber to an injection position where the molten material is injected or shot into the die cavity.

Heretofore, various means have been provided for moving the vertical oriented cylinder shot mechanism from the molten metal receiving position to a shot injection position and vice versa. For example, reference is made to U.S. Pat. No. 4,286,648 issued on Sep. 1, 1981, in which the injection cylinder is moved from the molten metal receiving position to the injection position by the combination of a power cylinder, a link mechanism, and a cam plate which includes a guide slot. The path of the injection or shot cylinder in the U.S. Pat. No. 4,286,648 patent is guided entirely by the cam plate which results in the roller riding within the cam slot. Practical tolerances needed for such designs usually lead to unrestricted "lost" motion which results in vibrating the injection cylinder mechanism which detrimentally agitates the molten metal within the mechanism. Further, although the apparatus of said patent may possibly decrease the interval between the so called teeming of the metal and the starting of the injection as compared to prior apparatus and as alleged in the patent, it is believed that the time interval is not significantly better than prior art apparatus. Improvement in the decrease of such time interval has had a long felt need.

The apparatus of the U.S. Pat. No. 4,286,648 patent also is complicated apparatus requiring substantial column-like structures for supporting a shot cylinder mechanism and also the mechanism for actuating the same.

SUMMARY OF THE INVENTION

The die casting machine of this invention and particularly the mechanism and structure for moving the shot cylinder mechanism from a molten metal receiving position to a shot injection position is a simple and uncomplicated structure. It is comprised of a minimum number of parts including a power cylinder and pivotal support member which in combination with linkage means supports the shot cylinder mechanism and provides for the movement of the mechanism from the molten metal receiving position to the shot or docked injection position. The path of the movement of the shot cylinder mechanism is controlled entirely by linkage means connected to the pivotal support member and the shot cylinder mechanism. This linkage means assists in the support of the shot cylinder mechanism, transmits motion of the power cylinder to the shot cylinder mechanism and also controls the path of the movement of the shot cylinder mechanism from the metal receiving position to the injection position and vice versa.

The mechanism of the present invention, as briefly described above, takes advantage of the constant speed of the power cylinder so as to give a faster or speedier non-linear motion in moving from the one position to the next during the largest part of the motion. Then, at the end of the injection position, wherein the shot sleeve of the shot cylinder mechanism enters the opening leading to the die cavity, greatly multiplied power cylinder force is exerted on the shot cylinder mechanism by reason of the greatest mechanical advantage at that point to provide a seal between the shot sleeve and said opening. Thus, the present invention provides for speed when speed is wanted, that is, from one position to the next, and power when power is wanted, that is, when the casting sleeve is to be locked and sealed in place just previous to the injection of the molten metal into the die cavity. Also, the geometry of the linkage system provides for very high mechanical differences in the locked positions minimizing any compliance typically found in direct acting hydraulic cylinders. All of this action is accomplished in a smooth way so as to not agitate the metal. Further, the time interval between the molten metal receiving position and the shot injection position is reduced to a minimum because of the faster and speedier non-linear motion permitted by the linkage means which functions as briefly described above.

These and other features, objects, and advantages of the present invention will become apparent upon reading the following description thereof, together with reference to the accompanying drawings in which:

DETAILED DESCRIPTION OF PREFERRED EMBODIMENTS

Figure 1:
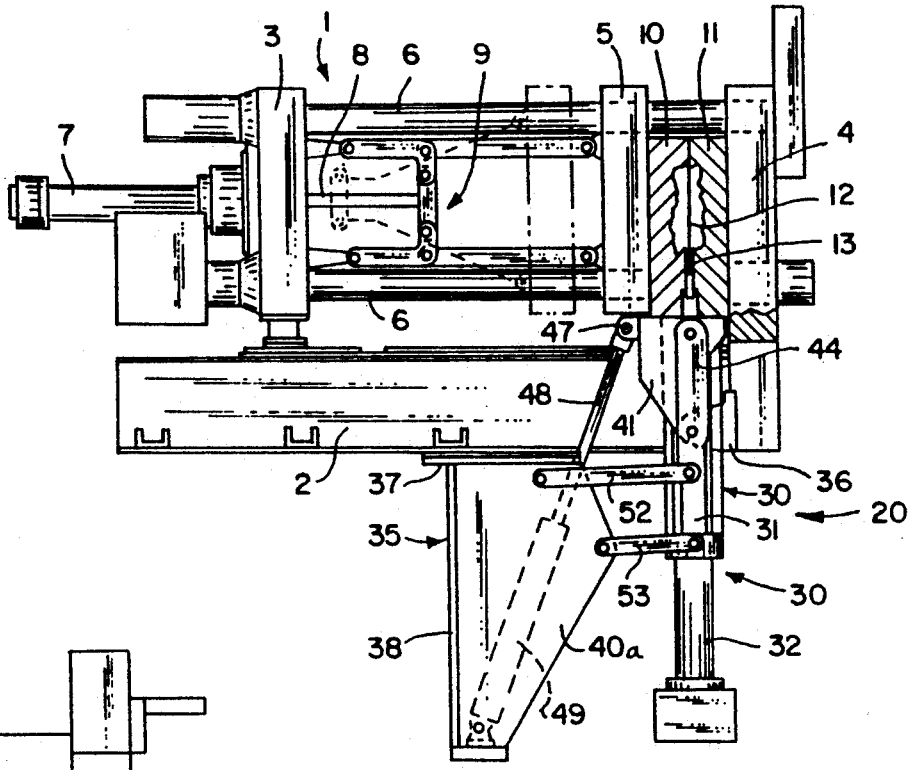
FIG. 1 is a side elevational, partially cross-sectioned view of a die casting machine in which the vertical shot mechanism of this invention is incorporated.

Referring to the drawings, FIG. 1 shows the die casting machine 1 with the vertical shot mechanism 20 mounted thereon.

Figure 6:
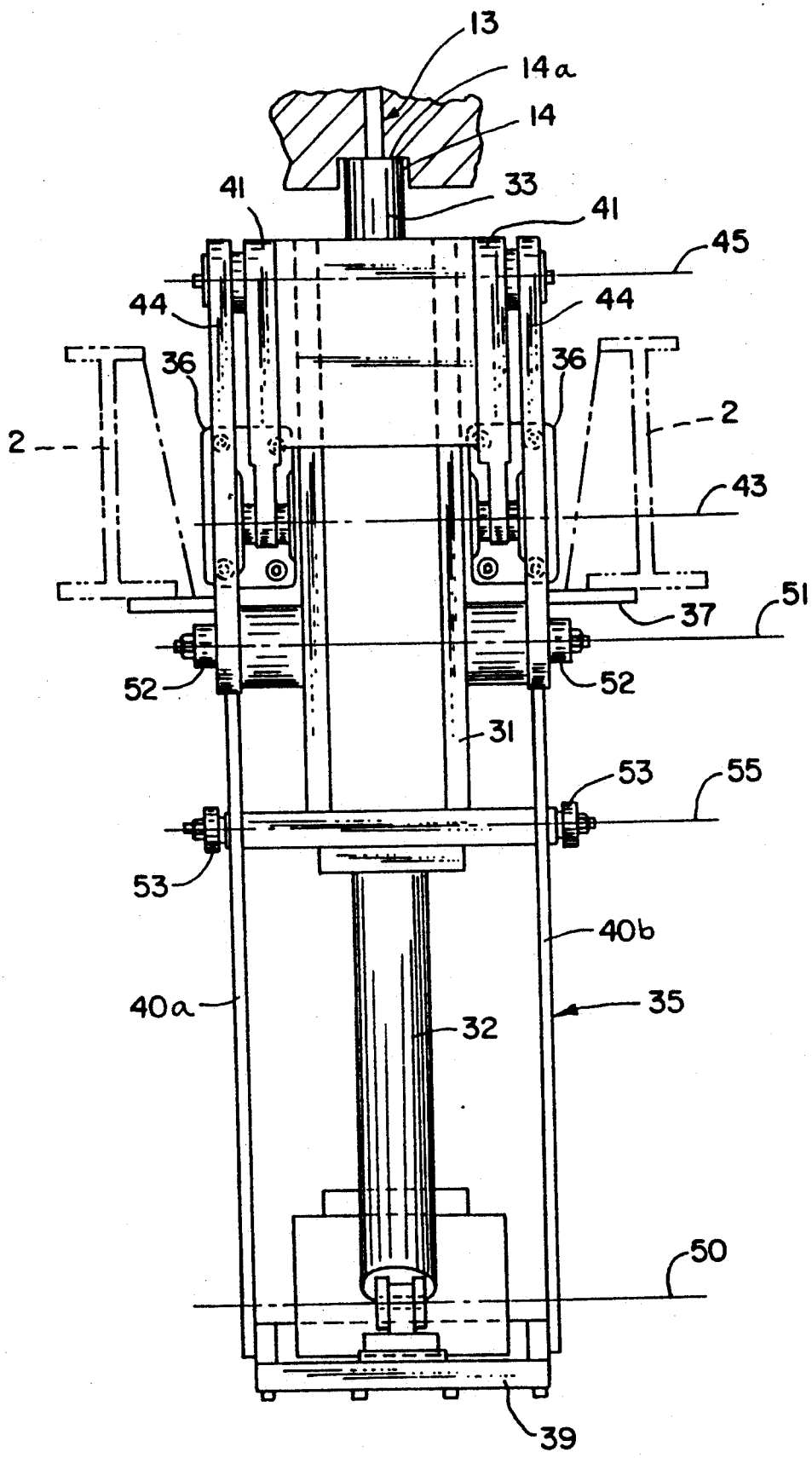
FIG. 6 is a rear elevational view of the vertical shot mechanism of FIG. 5 looking in the direction of arrows VI—VI in FIG. 5.

The die casting machine is of a well known type. An example of the same is disclosed in the assignee's U.S. Pat. Nos. 3,407,685, Re. 32,048, and 4,716,952. This typical type of die casting machine includes three major force components including the back plate 3, the front plate or stationary platen 4, and the movable platen 5 which is slideably mounted on the base support 2 between the back plate 3 and the front plate or platen 4. Front plate 4 and back plate 3 are connected to each other by four tie bars designated by the reference numeral 6. Movable platen 5 is journalled on tie bars 6 such that the tie bars act as a guide during the traverse of platen 5 into and out of the closing and opening of the die. A conventional hydraulic ram 7 is mounted on the back plate 3 and has an actuating rod 8 extending therethrough and connected to a conventional die casting toggle linkage indicated schematically at 9. The die halves 10 and 11 are mounted in the manner shown into the space between the movable platen 5 and the front plate or platen 4. Thus, as the ram 7 is activated, the actuating rod 8 causes toggle linkage 9 to straighten, thus forcing movable platen 5 and die half 10 forward. When the position shown in solid lines in FIG. 1 has been reached, toggle linkage 9 locks and the mold parts are held in the position shown to form the die cavity 12 into which the molten metal is to be injected through the opening 13. The opening 13 leads into the mold cavity and includes an enlarged portion 14, as more clearly disclosed in FIG. 6, for receiving the shot sleeve of the vertical shot mechanism as will be described hereinafter.

Figure 4:
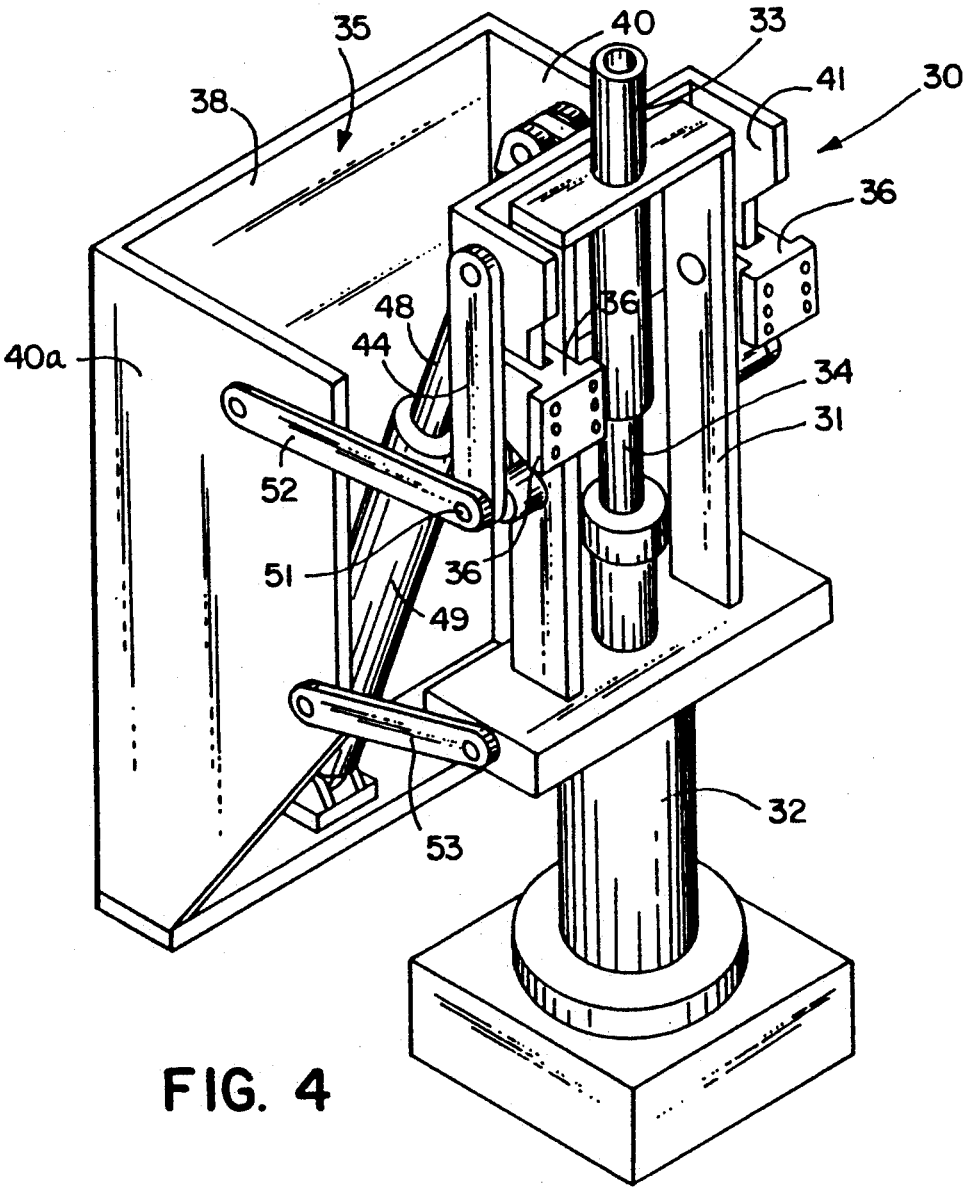
FIG. 4 is an elevational perspective view of the vertical shot mechanism of this invention.
Figure 5A:
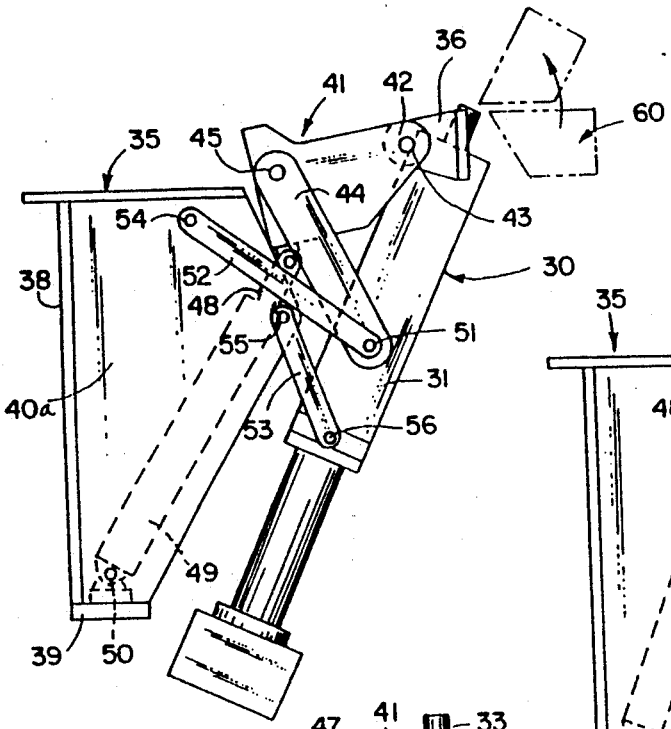
FIG. 5*a* is a side elevational view of the mechanism of FIG. 5 in the molten metal receiving position, showing in schematic the ladle.
Figure 5B:
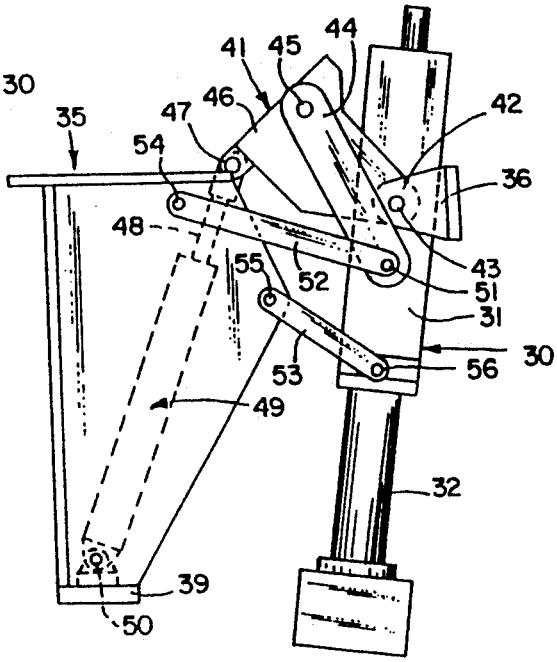
FIG. 5*b* is a side elevational view of the vertical shot mechanism of FIG. 5 in a position intermediate the positions of FIGS. 5 and 5*a;*
Figure 5:
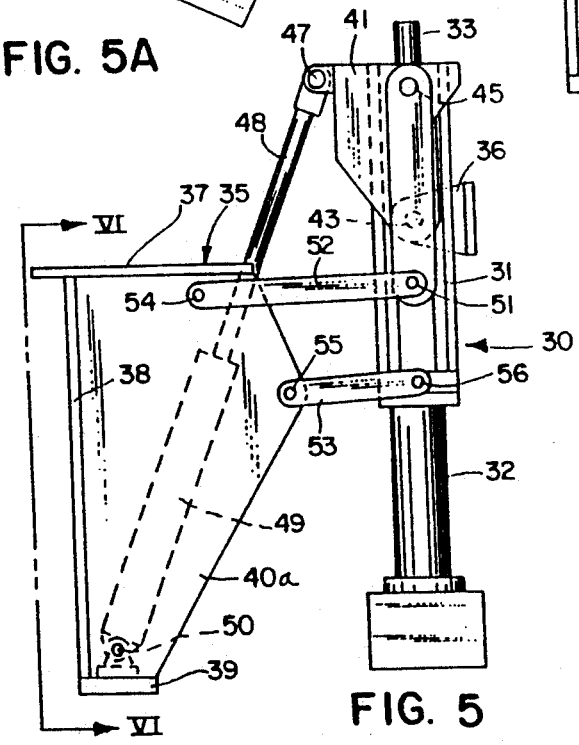
FIG. 5 is a side elevational view of the vertical shot mechanism in the shot or docking position.

Now referring to the vertical shot mechanism 20, it will be observed from FIGS. 5, 5*a*, and 5*b* that it includes several subcombinations. The first subcombination is the cylindrical shot mechanism 30 which includes a support frame 31 supporting injection cylinder 32 which includes a conventional piston (not shown) for extending and retracting the plunger rod 34 (FIG. 4) that extends into a casting sleeve 33 supported at the upper end of the support frame 31. Sleeve 33 has a chamber for receiving molten metal which is injected by plunger rod 34 into the opening 13 leading to the die cavity 12. As previously described and is more clearly disclosed in FIG. 6, the shot sleeve 33 is received within the enlarged portion 14 of the opening 13. The present invention is directed to the means for moving the shot cylinder mechanism 30 from the molten metal receiving position as disclosed in FIG. 5*a* to the docked or locked position of FIG. 5.

Figure 2:
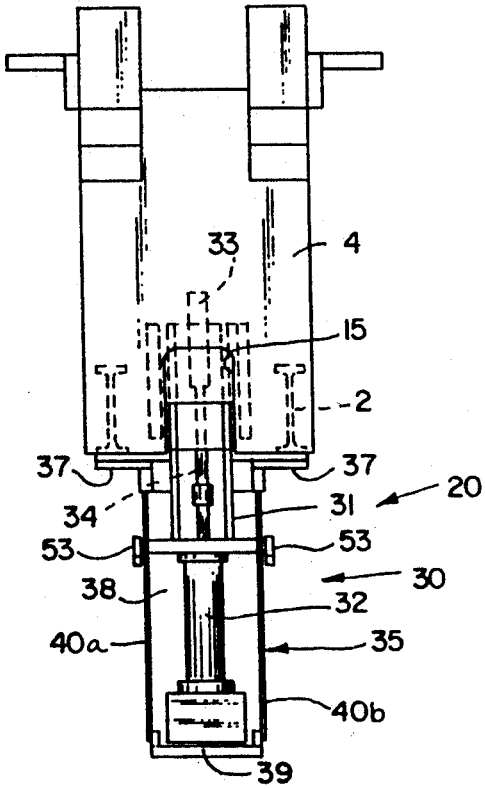
FIG. 2 is a front elevational view of the die casting machine of FIG. 1.
Figure 3:
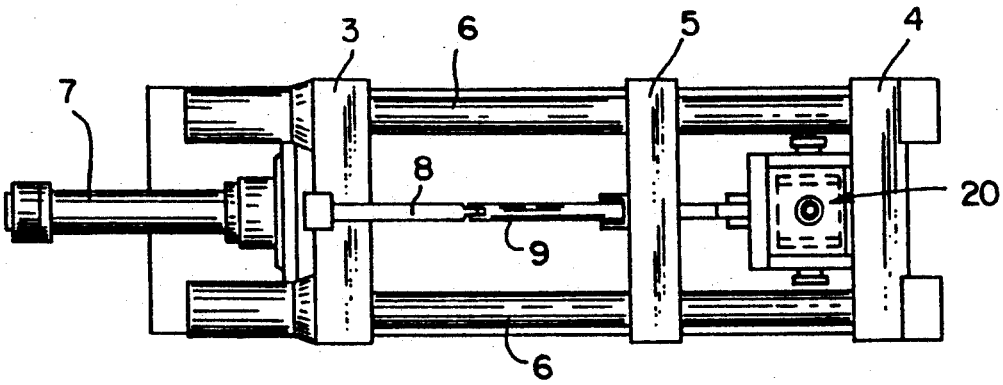
FIG. 3 is a top elevational view of the die casting machine of FIG. 1 with the mold parts deleted to show the location of the vertical shot mechanism relative to the remaining structure of the die casting machine.

In the position of FIG. 5*a*, the sleeve end of the shot cylinder mechanism 30 is swung through the opening 15 (FIG. 2) of the front plate 4 whereas when shot sleeve 33 is in the injection position, it is located in a sealed position within the enlarged opening portion 14 of the opening 13 leading to the die cavity 12.

The major support members for the shot cylinder mechanism 30 include the U-shaped support member 35 and the anchors 36 both of which are fixed relative to the support base 2 so as to provide proper orientation of the shot sleeve 33 when it is in the docking or shot position of FIG. 5 or in the molten metal receiving position of FIG. 5*a*.

The U-shaped support member 35 (FIGS. 1 and 2) includes a plate 37 (FIGS. 1 and 2) mounted to the bottom surfaces of the support base members 2. A back wall 38 extends downwardly from the top plate 37 and terminates at a lower support plate 39. Side plates 40*a* and 40*b* also extend downwardly and are attached to the edges of the top plate 37, the back plate 38 and the lower support plate 39. The U-shaped support member 35 serves the purpose of providing fixed pivotal supports for the actuator means and guide means, as will be described hereinafter.

The anchors 36 are spaced one from the other and pivotally support the U-shaped yoke 41 at one of its ends 42 about the axis 43 (FIGS. 5, 5*a*, and 5*b*). Drag or power links 44 are pivotally mounted at the other end 46 of yoke 41 about the axis 45. Also pivotally attached to the end 46 about the axis 47 is the piston rod 48 of the actuating or power cylinder 49 which is pivoted at its other end about axis 50 on the lower support plate 39. U-shaped support member 35, the power cylinder 49, the yoke 41, anchors 36, and links 44 all provide the support means for the shot cylinder mechanism.

The power cylinder 49, yoke 41, and drag or power links 44 also provide means for moving the casting sleeve 33 of the soot cylinder mechanism from the molten metal receiving position of FIG. 5*a* to the shot or locked position of FIG. 5. This is accomplished by the power exerted by piston rod 48 causing the yoke 41 to rotate, such rotational movement of yoke 41 being transmitted to the drag or power links 44 which are pivotally mounted about the axis 51 on each side of the support frame 31 of the shot cylinder mechanism 30 and transmits motion and power from yoke 41 to the shot end of shot cylinder mechanism 30.

The means for guiding the swinging path of shot cylinder mechanism 30 is primarily the guide links 52 and 53 which are pivotally mounted about the axes 54 and 55, respectively, on each side of the plates 40*a* and 40*b*. Guide links 52 and 53 are also pivotally connected to shot support frame 31, about the axes 51 and 56, respectively.

The location of the various pivot axes 43, 45, 47, 50, 51 54, 55, and 56, provide for a smooth non-linear movement of shot cylinder mechanism from the one position of FIG. 5*a* to the position of FIG. 5 and vice versa. In other words, the geometry of the entire system takes advantage of the constant speed of the cylinder to give not only a faster, speedier, non-linear motion in moving from one position to the next, but the swinging movement is much smoother since the entire motion is primarily a simultaneous movement in both the horizontal and vertical directions in open space without any obstructions and without any sudden changes in direction. Further, as the shot sleeve 33 initiates its entry into the large part 14 of opening 13, the geometry of the entire system provides the greatest mechanical advantage at that point which causes the shot sleeve 33 to provide a seal with opening 13. Therefore, when the molten metal is injected from shot sleeve 33 through the opening 13 into the mold cavity 12, minimum leakage is encountered.

Figure 7:
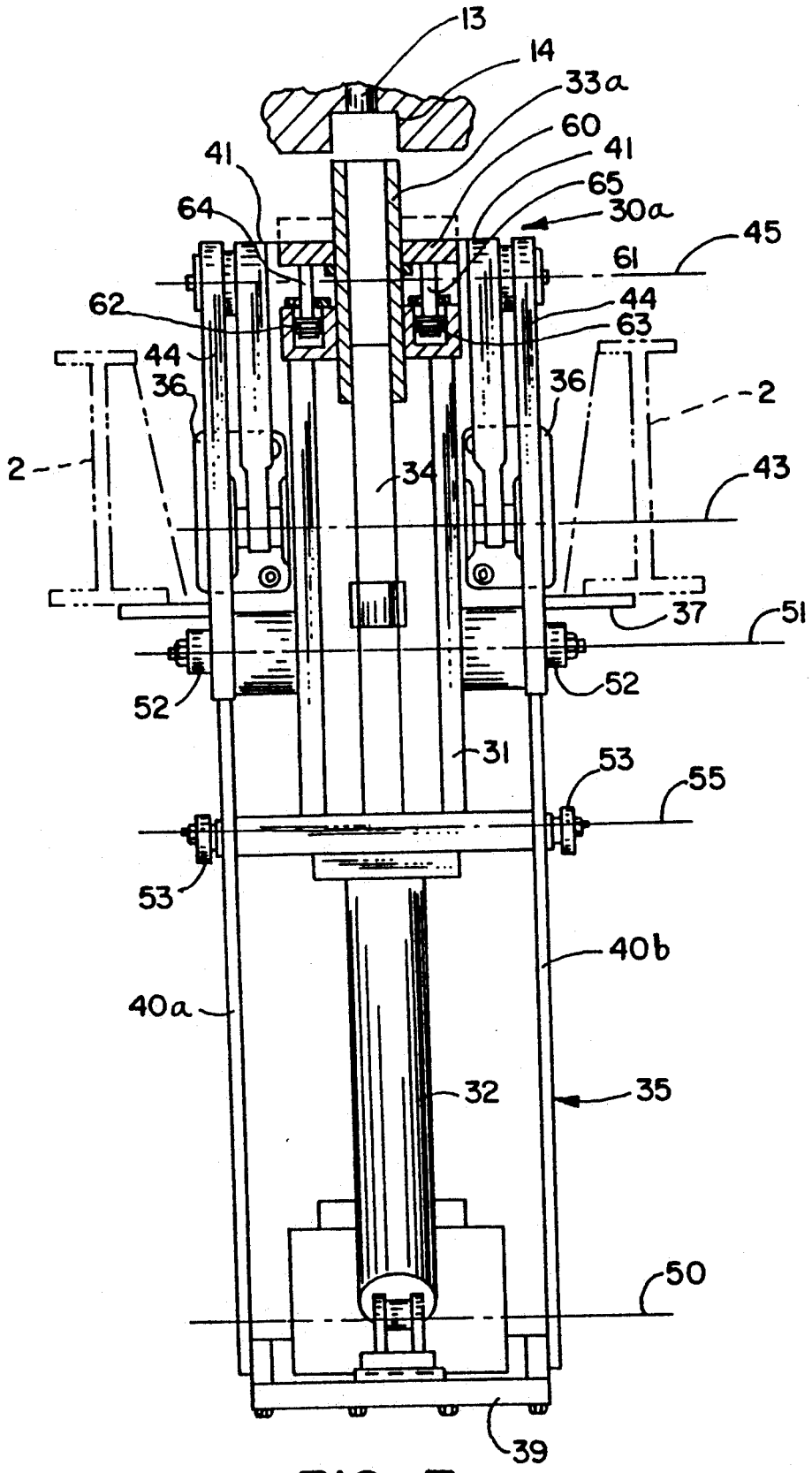
FIG. 7 is a rear elevational view similar to FIG. 6 but disclosing a modified final docking mechanism.

FIG. 7 discloses a slightly modified shot cylinder mechanism 30*a* which includes the shot sleeve 33*a* movably mounted on the frame support 31 by means of a piston assembly 61. Bar 60 is supported by piston rods 64 and 65 connected to pistons 62 and 63, respectively. This slot sleeve mechanism 30*a* is especially useful in horizontal-vertical applications where the tolerances required for the swinging and docking of the shot sleeve in the die opening 14 is difficult to achieve because of the slightly different shapes, sizes, and locations of opening 14 in different dies. With the mechanism 30*a*, the shot sleeve 33*a* can be swung into position immediately below die opening 14 as shown by solid lines and then moved upwardly by pistons 62 and 63 into docking position in die opening 14 as disclosed by the broken lines.

OPERATION

Having described the essential elements of the vertical shot mechanism of this invention and the function which each of them perform, the operation of the vertical shot mechanism in the die casting operation of the die casting machine 1 should be quite evident. Assuming the mold parts 10 and 11 have been properly secured to the front platen 4 and movable platen 5, respectively, the die cavity 12 is then prepared to receive molten metal to be injected through the opening 13 by the shot cylinder mechanism 30. The vertical shot mechanism is then put into operation by manual or automatic control causing the shot cylinder mechanism 30 to be in the position of FIG. 5*a* ready to receive molten metal from the ladle 60 which is disclosed in phantom in FIG. 5*a*.

The position of FIG. 5*a* is accomplished by actuating the power cylinder 49 so as to cause the piston rod 48 to be withdrawn within the cylinder. When withdrawn, rod 48 pivots the yoke 41 causing it to move from the position of FIG. 5 to the position of FIG. 5*a*. This occurs by the yoke 41 exerting a force on the drag or power link 44 which swings the shot cylinder mechanism 30 to position such as shown in FIG. 5*b* and eventually to the position as disclosed in FIG. 5*a*. During the swing of the shot cylinder mechanism from the position of FIG. 5 to the position of FIG. 5*a*, or vice Versa, the guide links 52, 53 and drag or power link 44 guide the shot cylinder mechanism as determined by the geometry of the entire system as described above. The swinging motion is a non-linear motion in both the horizontal and vertical direction. As piston rod 48 of power cylinder 49 exerts a constant speed and power to rotate the yoke 41, the geometry of the entire system takes advantage of such constant speed to give a faster and smoother movement of the shot cylinder mechanism until at the very end of the motion near injection position, a final upward force is exerted on the shot cylinder mechanism by reason of the greatest mechanical advantage at that point. At this point, when the shot cylinder mechanism reaches its injection position, the axes 45, 43, and 51 are substantially, but not quite, in vertical alignment. The axes 45, 43, and 51 are not quite aligned because it is essential before the shot takes place that the shot sleeve 33 be sealed on the shoulder 14*a* (FIG. 6) formed between the enlarged opening 14 and the remainder of the opening 13. The reason for this is the difficulty in obtaining proper tolerances necessary to assure a seal. Nevertheless, the axes 45, 43, and 51 are substantially vertically aligned when the shot cylinder mechanism is in injection position as disclosed in FIG. 5.

Once the shot cylinder mechanism is in position with a proper volume of molten metal within the sleeve 33, the injection cylinder 32 is operated causing the plunger within the shot sleeve to inject the molten metal into the die cavity 12.

As previously disclosed, in some applications it is desirable to swing the slot sleeve into a position immediately below the die opening 14 and then force the slot sleeve into the die opening 14. FIG. 7 discloses a modified shot mechanism 30*a* in which after the shot sleeve is swung into position below die opening 14, pistons 62 and 63 force shot sleeve 33*a* upwardly into docking position.

Having described our invention, it should become obvious that we have provided a smoothly operating apparatus for moving the shot cylinder mechanism 30 from the molten metal receiving position of FIG. 5*a* to the injection position of FIG. 5. This smooth swinging motion of the shot cylinder mechanism in open space carries the molten metal within the shot sleeve 33 so as to not agitate the metal. Further, any limitation on the speed of movement is greatly reduced to substantially cut the time interval between the pouring of the molten metal into the shot sleeve and the injection of the molten metal into the die cavity. In addition, the sealing of the shot sleeve within the opening leading to the die cavity is greatly enhanced by the present invention. All of these advantages provide for a greatly improved vertical shot mechanism.

In the foregoing description, it will be readily appreciated by those skilled in the art that modifications may be made to the invention without departing from the concepts disclosed herein. Such modifications are to be considered as included in the following claims unless these claims by their language expressly state otherwise.

We claim:

The embodiments of the invention in which an exclusive property or privilege is claimed are defined as follows:

1. In a die casting machine having a base support means supporting opposing dies with means for providing relative movement between said dies for urging at least one die against the other to define a die cavity between said dies;

a die cavity opening leading into said die cavity;

a shot cylinder mechanism supported below said dies for injecting molten metal into said die cavity through said die cavity opening;

means for moving said shot cylinder mechanism from a molten metal receiving position for receiving molten metal to a shot injection position for injecting molten metal into said die cavity; the improvement wherein the means for moving said shot cylinder mechanism comprises:

motive power means pivotal about a first axis;

a pivotal support member pivotal about a second axis fixed relative to said opening leading into said die cavity;

said motive power means being pivotally connected to said support member for pivoting said support member about said second axis; and link means connected to said pivotal support member and said shot cylinder mechanism for supporting said shot cylinder mechanism, transmitting the motion of said motive power means to said shot cylinder mechanism, and for controlling the path of movement of said shot cylinder mechanism from said metal receiving position to said shot injection position under said die cavity and vice versa.

2. In the die casting machine of claim 1 in which said link means includes a power transmitting link means pivotally connected to and between said support member and said shot cylinder mechanism, said link means also including pivotal guide link means for guiding the path of the movement of said shot cylinder mechanism.

3. The die casting machine of claim 2 in which said support member is a U-shaped yoke having spaced arms for receiving said shot cylinder mechanism therebetween and said power transmitting link means includes a pair of power transmitting links pivotally connected one to each of said arms and to opposing sides of said shot cylinder mechanism.

4. The die casting machine of claim 2 in which the support member pivotally supports said shot cylinder mechanism by means of said power transmitting link means, said power transmitting link means being pivotally connected to said support member about a third axis and to said shot cylinder mechanism about a fourth axis whereby when said shot cylinder mechanism is in a position wherein said second, third and fourth axes are substantially aligned said shot cylinder mechanism is locked into shot position.

5. The die casting machine of claim 3 in which said guide link means comprises two pair of guide links, said pairs of guide links each being pivotally supported at one of its ends by said base support means and the other of said ends of said guide links being pivotally connected to said shot cylinder mechanism, said pivotal connections of said guide links to said shot cylinder mechanism being located on spaced parallel axes extending through said shot cylinder mechanism.

6. The die casting machine of claim 1 in which the motive power means comprises an elongated power cylinder rigidly supported at one end relative to said base support means and connected at the other end to said pivotal support member for pivoting said pivotal support member about said first axis.

7. The die casting machine of claim 2 in which the motive power means comprises an elongated power cylinder rigidly supported at one end relative to said base support means and connected at the other end to said pivotal support member for pivoting said pivotal support member about said first axis.

8. The die casting machine of claim 7 in which said support member is a U-shaped yoke having spaced arms for receiving said shot cylinder mechanism therebetween and said power transmitting link means includes a pair of power transmitting links pivotally connected one to each of said arms and to opposing sides of said shot cylinder mechanism.

9. The die casting machine of claim 4 in which the motive power means comprises an elongated power cylinder rigidly supported at one end relative to said base support means and connected at the other end to said pivotal support member for pivoting said pivotal support member about said second axis.

10. The die casting machine of claim 8 in which said guide link means comprises two pair of guide links, said pairs of guide links each being pivotally supported at one of its ends by said base support means and the other of said ends of said guide links being pivotally connected to said shot cylinder mechanism, said pivotal connections of said guide links to said shot cylinder mechanism being located on spaced parallel axes extending through said shot cylinder mechanism.

11. In a die casting machine having a base support means supporting opposing dies with means for providing relative movement between said dies for urging at least one die against the other to define a die cavity between said dies;

a die cavity opening leading into said die cavity;

a shot cylinder mechanism supported below said dies for injecting molten metal into said die cavity through said die cavity opening;

means for moving said shot cylinder mechanism from a molten metal receiving position for receiving molten metal to a shot injection position for injecting molten metal into said die cavity; the improvement wherein the means for moving said shot cylinder mechanism comprises:

an elongated power cylinder;

means for pivotally supporting said power cylinder about a first axis below said dies; said power cylinder being spaced from one side of said shot cylinder mechanism;

said power cylinder being pivotally mounted and having connecting means at one end for operatively connecting said power cylinder to said shot cylinder mechanism; and linkage means connected to said shot cylinder mechanism for transmitting power from said power cylinder to said shot cylinder mechanism and for guiding said shot cylinder mechanism when power is applied by said power cylinder mechanism for swinging said shot cylinder in open space simultaneously in non-linear horizontal and vertical directions from said molten metal receiving position to said injection position, and vice versa, whereby the movement of said shot cylinder mechanism to and from said positions is accomplished solely by the power exerted by said power cylinder, and the guiding movement of said shot cylinder mechanism is accomplished solely by said linkage means.

12. The die casting machine of claim 11 in which said connecting means is connected to a pivotally mounted support member, said support member being pivotal about a second axis fixed relative to said first axis and fixed relative to said die cavity opening, said shot cylinder being pivotally supported by said support member.

13. In the die casting machine of claim 12 in which said link means includes a power transmitting link means pivotally connected to and between said support member and said shot cylinder mechanism, said link means also including pivotal guide link means for guiding the path of the movement of said shot cylinder mechanism.

14. In the die casting machine of claim 13 in which said support member is a U-shaped yoke having spaced arms for receiving said shot cylinder mechanism therebetween and said power transmitting link means includes a pair of power transmitting links pivotally connected about a third axis to said yoke, one to each of said arms and pivotally connected about a fourth axis to opposing sides of said shot cylinder mechanism.

15. The die casting machine of claim 14 in which said guide link means comprises first and second guide links, said first guide link pivotal at one of its ends about a fifth axis fixed relative to said first axis and pivotal at its other end to said shot cylinder about a sixth axis, said second guide link pivotal at one of its ends about a seventh axis fixed relative to said first axis and pivotal at its other end to said shot cylinder about an eighth axis, said first, second, fifth, and seventh axes being fixed relative to each other and relative to said die cavity opening, and said fourth and sixth axes being fixed relative to each other but constantly changing relative to said first, second, fifth, and seventh axis as the shot cylinder is moved by said power cylinder.

16. The die casting machine of claim 15 in which when said shot cylinder mechanism is in a position wherein when said first, third and fourth axes are substantially aligned said shot cylinder mechanism is locked into shot position.

17. In a die casting machine having a base support means supporting opposing dies with means for providing relative movement between said dies for urging at least one die against the other to define a die cavity between said dies;

a die cavity opening leading into said die cavity;

a shot cylinder mechanism supported below said dies for injecting molten metal into said die cavity through said die cavity opening;

means for moving said shot cylinder mechanism from a molten metal receiving position for receiving molten metal to a shot injection position for injecting molten metal into said die cavity; the improvement wherein the means for moving said shot cylinder mechanism comprises:

said base support means including a support frame means depending downwardly below said dies;

a first pivotal support means on said support frame means;

a second pivotal support means on said support frame means;

a third pivotal support means on said support frame means;

a power cylinder pivotally supported at one end by said first pivotal support means and at its other end operatively connected to said shot cylinder mechanism;

a first guide link pivotally supported at one end by said second pivotal support means and at its other end pivotally attached to said shot cylinder mechanism;

a second guide link pivotally supported at one end by said third pivotal support means and at it other end pivotally attached to said shot cylinder mechanism;

an elongated pivotal support member having two ends, one of said ends being pivotally supported about an axis fixed relative to said die cavity opening and said base support means;

a power link pivotally connected to the other end of said pivotal support member and to said shot cylinder mechanism whereby power exerted by said power cylinder pivots said pivotal support member to transmit power to said power link to move said shot cylinder mechanism which is guided by said first and second guide links to swing said shot cylinder mechanism in open space simultaneously in non-linear horizontal and vertical directions from said molten metal receiving position to a position under said die cavity.

18. The die casting machine of claim 17 in which said support member is a U-shaped yoke having spaced arms for receiving said shot cylinder mechanism therebetween and said power transmitting link means includes a pair of power transmitting links pivotally connected one to each of said arms and to opposing sides of said shot cylinder mechanism.

19. The die casting machine of claim 18 in which said guide link means comprises two pair of guide links, said pairs of guide links each being pivotally supported at one of its ends by said base support means and the other of said ends of said guide links being pivotally connected to said shot cylinder mechanism, said pivotal connections of said guide links to said shot cylinder mechanism being located on spaced parallel axes extending through said shot cylinder mechanism.

20. The die casting machine of claim 17 in which said position under said die cavity is the said shot injection position.

21. The die casting machine of claim 17 in which the said position under said die cavity is below the shot injection position aligned with the die cavity opening and means for forcing said shot cylinder mechanism into said shot injection position.

22. The die casting machine of claim 18 in which said position under said die cavity is the said shot injection position and the pivotal axes of said support member at said one end, the pivotal axis of said support member at the pivotal connection of said other end to said power link, and the pivotal axis of said power link to said shot cylinder mechanism are substantially aligned when the shot cylinder mechanism is locked in said shot injection position.

* * * * *

UNITED STATES PATENT AND TRADEMARK OFFICE

CERTIFICATE OF CORRECTION

PATENT NO. : 5,284,201

DATED : February 8, 1994

INVENTOR(S) : Robert Hegel et al.

It is certified that error appears in the above-indentified patent and that said Letters Patent is hereby corrected as shown below:

Column 4, line 8:
"soot" should be --shot--.

Column 5, line 17:
After "to" insert --a--.

Column 6, claim 2, line 48:
"In the" should be --The--.

Column 7, claim 4, line 2:
After "into" insert --said--.

Column 7, claim 4, line 2:
After "shot" insert --injection--.

Column 8, claim 11, line 8:
After "cylinder" (second occurrence) insert --mechanism--.

Column 8, claim 12, line 22:
After "cylinder" insert --mechanism--.

Column 8, claim 13, line 23:
"In the" should be --The--.

Column 8, claim 13, line 24:
"link" should be --linkage--.

UNITED STATES PATENT AND TRADEMARK OFFICE

CERTIFICATE OF CORRECTION

PATENT NO. : 5,284,201
DATED : February 8, 1994
INVENTOR(S) : Robert Hegel et al.

It is certified that error appears in the above-indentified patent and that said Letters Patent is hereby corrected as shown below:

Column 8, claim 13, line 26:
"link" should be --linkage--.

Column 8, claim 14, line 30:
"In the" should be --The--.

Column 8, claim 14, line 35:
After "one" insert --link--.

Column 8, claim 15, line 42:
After "cylinder" insert --mechanism--.

Column 8, claim 15, line 45:
After "cylinder" insert --mechanism--.

Column 8, claim 15, line 51:
After "cylinder" insert --mechanism--.

Column 8, claim 16, line 54:
"first" should be --second--.

Column 8, claim 16, line 56:
"shot position" should be --said shot injection position--.

Column 10, claim 18, line 6:
"transmitting link means" should be --link--.

UNITED STATES PATENT AND TRADEMARK OFFICE

CERTIFICATE OF CORRECTION

PATENT NO. : 5,284,201

DATED : February 8, 1994

INVENTOR(S) : Robert Hegel et al.

It is certified that error appears in the above-indentified patent and that said Letters Patent is hereby corrected as shown below:

Column 10, claim 19, line 11:
"guide link means comprises" should be --guide links comprise--.

Signed and Sealed this

Eighteenth Day of October, 1994

*Attest:*

Bruce Lehman

BRUCE LEHMAN

*Attesting Officer*

*Commissioner of Patents and Trademarks*